US009593601B2

(12) United States Patent
Chern et al.

(10) Patent No.: US 9,593,601 B2
(45) Date of Patent: Mar. 14, 2017

(54) IMPACT DAMPENING TAPPET

(71) Applicant: Ford Global Technologies, LLC, Dearborn, MI (US)

(72) Inventors: Yitzong Chern, Troy, MI (US); Chong Jack Chen, Bloomfield Hills, MI (US); Stanley Berlinski, Grosse Ile, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 14/585,031

(22) Filed: Dec. 29, 2014

(65) Prior Publication Data

US 2015/0107541 A1 Apr. 23, 2015

Related U.S. Application Data

(62) Division of application No. 13/535,171, filed on Jun. 27, 2012, now Pat. No. 8,919,312.

(51) Int. Cl.
*F01L 1/16* (2006.01)
*F01L 1/14* (2006.01)

(52) U.S. Cl.
CPC ..... *F01L 1/16* (2013.01); *F01L 1/143* (2013.01); *F01L 2101/00* (2013.01); *F01L 2810/04* (2013.01)

(58) Field of Classification Search
CPC ..... F01L 1/143; F01L 1/14; F01L 1/16; F01L 2101/00; F01L 2810/04
USPC ..... 123/90.44, 90.48, 90.49, 90.52
See application file for complete search history.

(56) References Cited

U.S. PATENT DOCUMENTS

| | | | | |
|---|---|---|---|---|
| 2,595,127 A | | 4/1952 | Coffey | |
| 2,694,388 A | | 11/1954 | Gammon et al. | |
| 4,430,970 A | * | 2/1984 | Holtzberg | F01L 1/143 123/90.51 |
| 4,643,144 A | * | 2/1987 | Fingerle | F01L 1/185 123/188.3 |
| 4,782,799 A | | 11/1988 | Goppelt et al. | |
| 5,088,455 A | * | 2/1992 | Moretz | F01L 1/14 123/90.5 |
| 5,309,874 A | * | 5/1994 | Willermet | F01L 1/143 123/90.51 |
| 6,349,689 B1 | * | 2/2002 | Warwick | F01L 1/14 123/90.5 |

(Continued)

FOREIGN PATENT DOCUMENTS

| | | |
|---|---|---|
| CN | 2675869 Y | 2/2005 |
| JP | H11257030 A | 9/1999 |

OTHER PUBLICATIONS

Partial Translation of Office Action of Chinese Application No. 201310259445.7, Issued Aug. 26, 2016, State Intellectual Property Office of PRC, 8 pages.

*Primary Examiner* — Ching Chang
(74) *Attorney, Agent, or Firm* — James Dottavio; John D. Russell; B. Ann McCoy

(57) ABSTRACT

A valve assembly is provided herein. The valve assembly may include a valve stem coupled to a coil spring and an impact dampening tappet partially enclosing the spring and valve stem and in contact with a cam, the impact dampening tappet including an exterior metal layer having a cam contacting surface and an interior elastomeric layer traversing at least a portion of the interior surface of the exterior metal layer.

11 Claims, 5 Drawing Sheets

(56) References Cited

U.S. PATENT DOCUMENTS

| | | | | |
|---|---|---|---|---|
| 2002/0162523 | A1* | 11/2002 | Ishihara | C23C 8/26 123/90.27 |
| 2006/0049035 | A1* | 3/2006 | Hosenfeldt | C23C 14/024 204/192.15 |
| 2006/0219200 | A1* | 10/2006 | Horimura | F01L 1/053 123/90.51 |
| 2007/0028872 | A1 | 2/2007 | Asano et al. | |
| 2010/0012064 | A1* | 1/2010 | Lyo | F01L 1/143 123/90.48 |
| 2010/0275875 | A1* | 11/2010 | Doi | C23C 8/10 123/197.3 |
| 2013/0291813 | A1* | 11/2013 | Kodai | C23C 8/00 123/90.6 |

* cited by examiner

IMPACT DAMPENING TAPPET

CROSS REFERENCE TO RELATED APPLICATIONS

The present application is a divisional of U.S patent application Ser. No. 13/535,171, entitled "IMPACT DAMPENING TAPPET," filed on Jun. 27, 2012, the entire contents of which are hereby incorporated by reference for all purposes.

BACKGROUND/SUMMARY

Valves in some internal combustion engines may be actuated by a camshaft having a plurality of rotating cams. The valves may be intake valves and/or exhaust valves coupled to cylinders in the engine. Tappets may be positioned between the cams and the valve stems to facilitate the transfer of energy from the camshaft to the valves, enabling actuation of the valves to perform combustion.

For example, U.S. Pat. No. 4,430,970 discloses a thermoplastic tappet positioned between a cam and a valve stem in order to reduce weight as compared to a metal tappet. However, the Inventors have recognized several drawbacks with using a thermoplastic tappet. For example, such tappets may have less compressive strength than metal tappets. As a result, the longevity of tappet may be decreased. Moreover, the thermoplastic tappet may become degraded when exposed to elevated temperatures during engine operation. Specifically, the thermoplastic tappet may deform due to elevated temperatures.

To address at least some of the aforementioned issues, a valve assembly is provided. The valve assembly may include a valve stem coupled to a spring and an impact dampening tappet partially enclosing the spring and the valve stem and in contact with a cam, the impact dampening tappet including an exterior metal layer having a cam contacting surface and an interior elastomeric layer traversing at least a portion of the interior surface of the exterior metal layer. The elastomeric layer enables the impact from the cam to the valve assembly to be reduced. This dampening reduces upstream as well as downstream force propagation caused by the impact between the cam and the tappet. As a result, the longevity of the valve, cam, and tappet is increased. Moreover, the likelihood of failure of the valve and the cam is decreased.

In some examples, the impact dampening tappet may further include an interior metal layer, the interior elastomeric layer being positioned between the exterior metal layer and the interior metal layer. Sandwiching the elastomeric layer between two metal layers holds the elastomeric layer in position, which reduces deformation of the elastomeric layer caused by temperature variations. Moreover, the sandwich construction provides improved spring-mass isolation, enabling damping of un-wanted frequencies, such as high frequencies.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE FIGURES

FIGS. 2-5 and 7 are drawn approximately to scale, although other relative dimensions may be used, if desired.

DETAILED DESCRIPTION

A valve assembly is provided herein. The valve assembly may include a valve stem coupled to a spring and an impact dampening tappet partially enclosing the spring and the valve stem and in contact with a cam. The impact dampening tappet may include an exterior metal layer having a cam contacting surface and an interior elastomeric layer traversing at least a portion of the interior surface of the exterior metal layer. In this way, the impact from the cam to the valve assembly may be dampened. As a result, the longevity of the valve as well as the cam is increased. Moreover, the likelihood of failure of the valve and the cam is decreased. Furthermore, the impact dampening tappet enables the noise generated in the valvetrain to be reduced when compared to tappets constructed solely out of metal. Furthermore, the impacts attenuated by the tappet also decrease force transmission upstream into the camshaft. As a result, the likelihood of camshaft deformation is reduced, thereby increasing the longevity of the camshaft.

Figure 1:
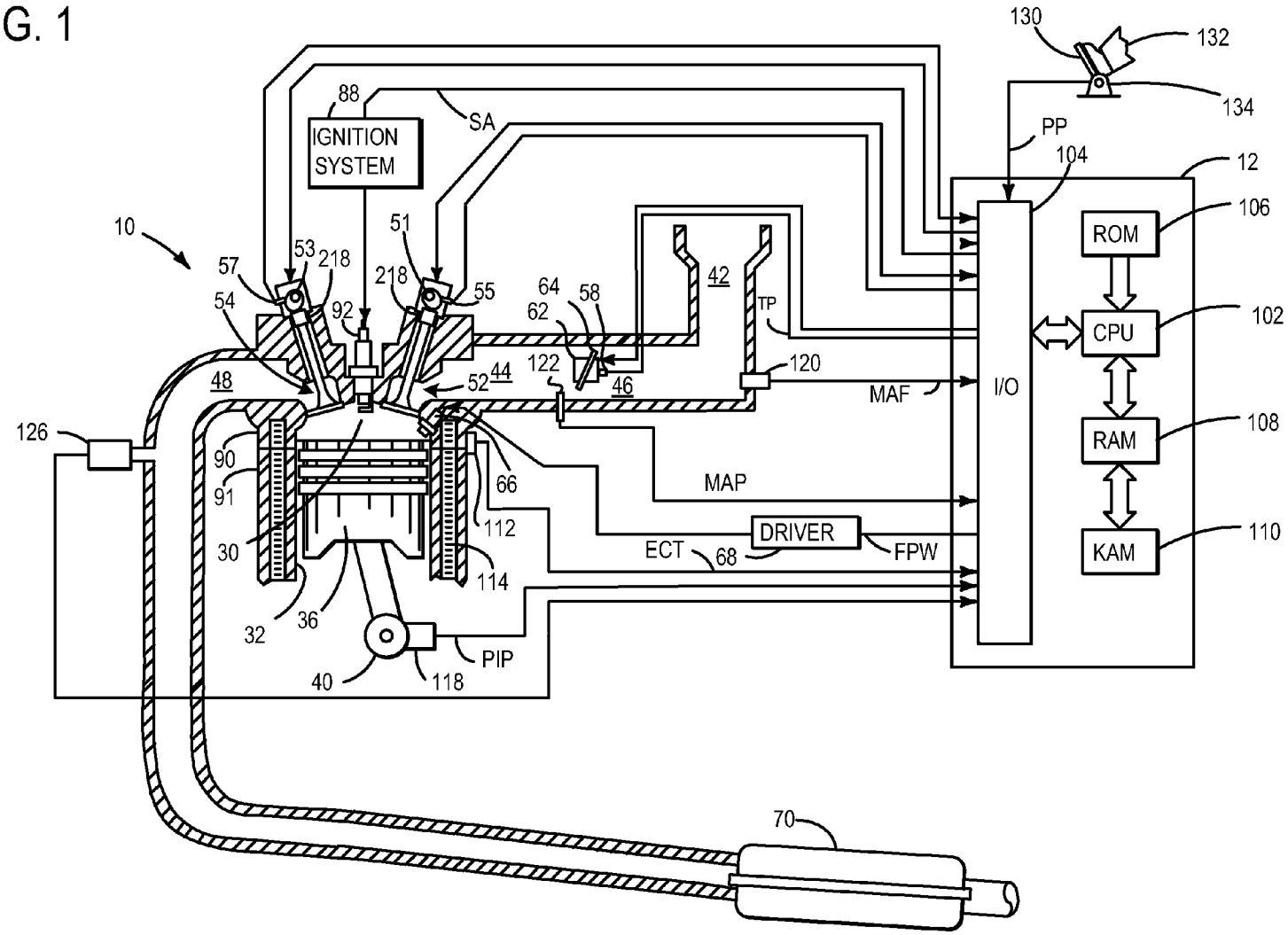
FIG. 1 shows a schematic depiction of an internal combustion engine.
Figure 2:
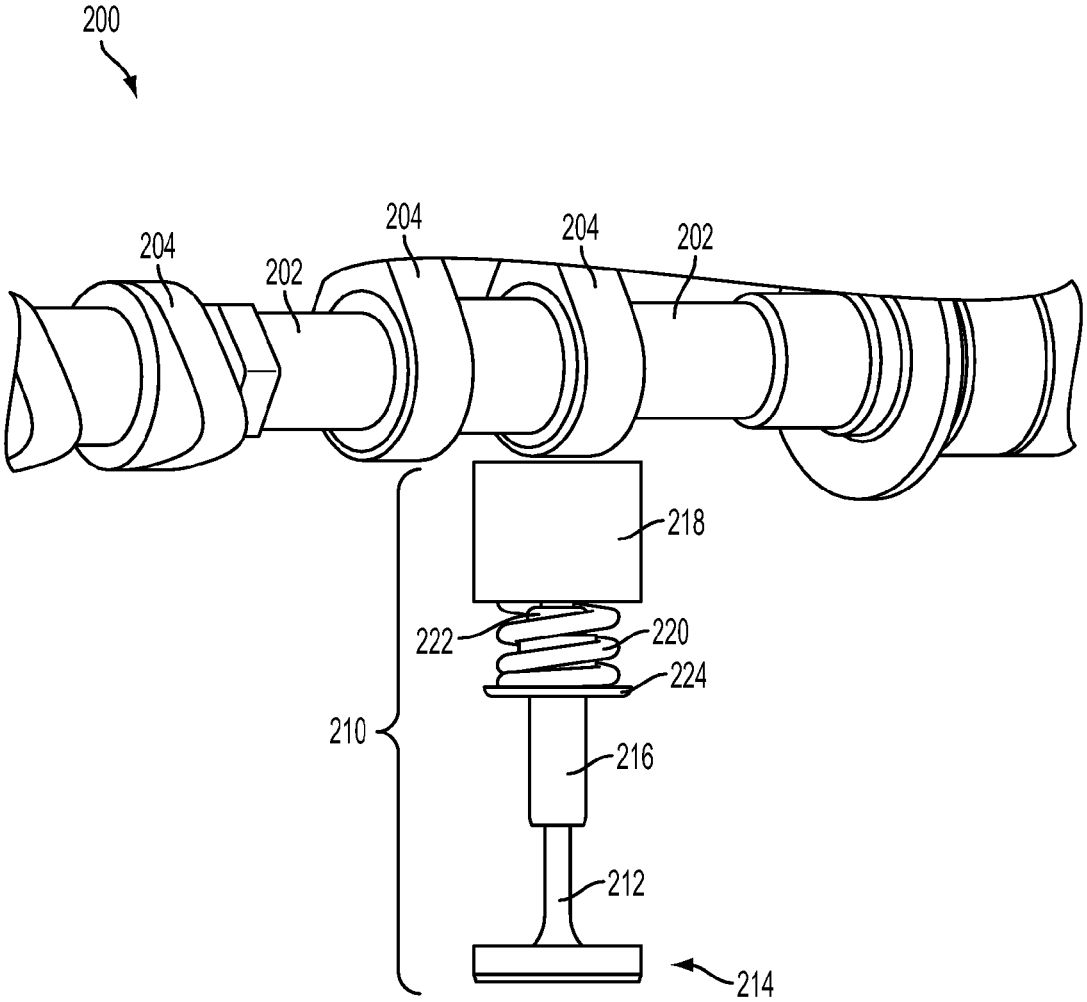
FIG. 2 shows an illustration of a valvetrain in the internal combustion engine shown in FIG. 1.
Figure 3:
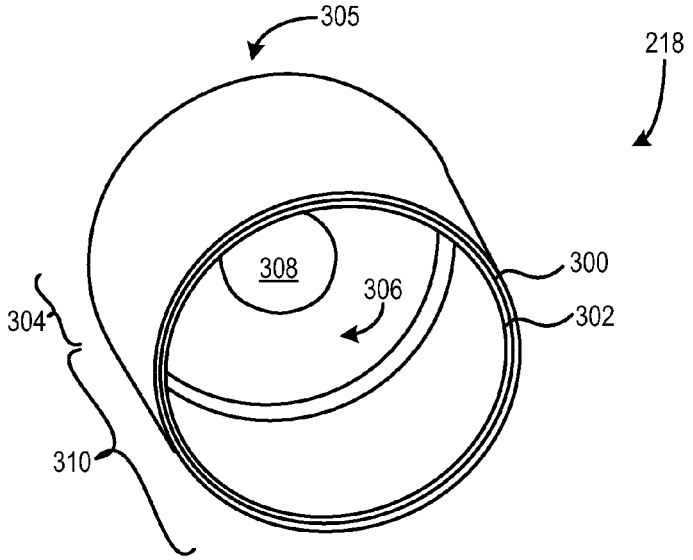
FIG. 3 shows a first embodiment of an impact dampening tappet included in the valvetrain shown in FIG. 2.
Figure 4:
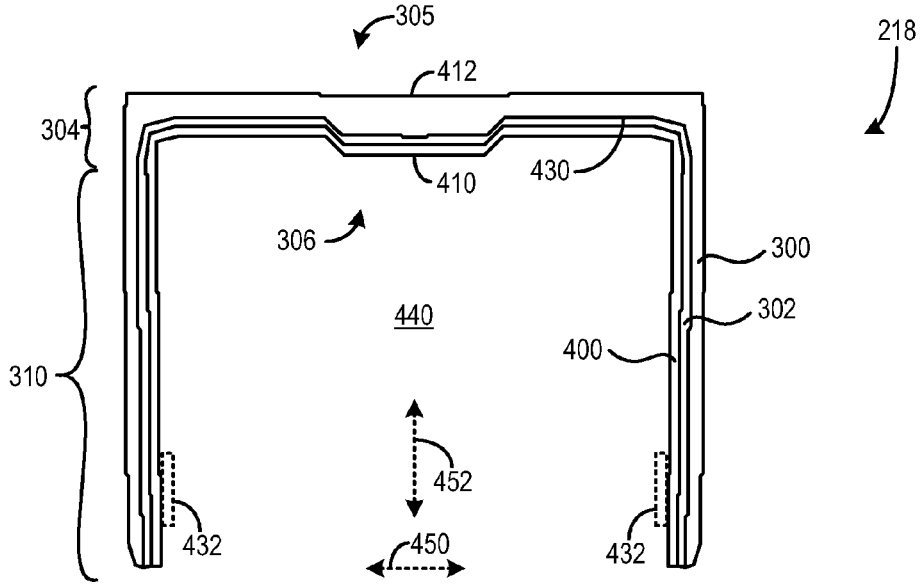
FIG. 4 shows a cross-sectional view of a second embodiment of the impact dampening tappet shown in FIG. 2.
Figure 5:
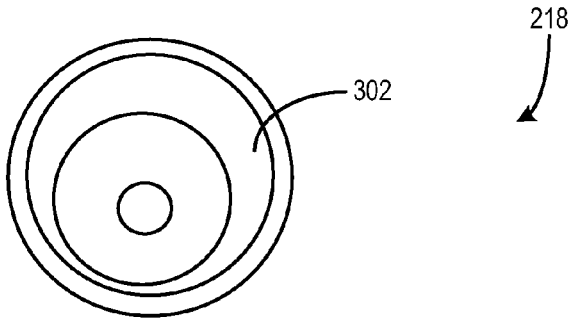
FIG. 5 shows a third embodiment of an impact dampening tappet included in the valve train shown in FIG. 2.
Figure 6:
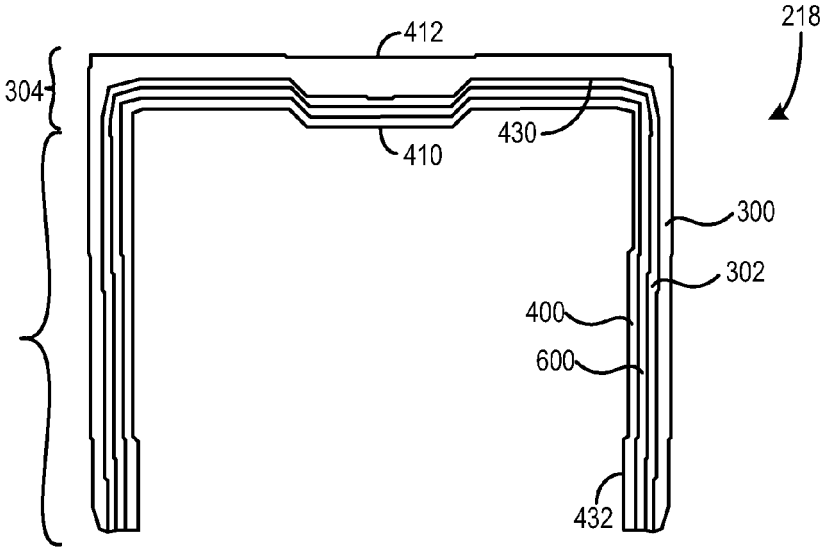
FIG. 6 shows a fourth embodiment of an impact dampening tappet.
Figure 7:
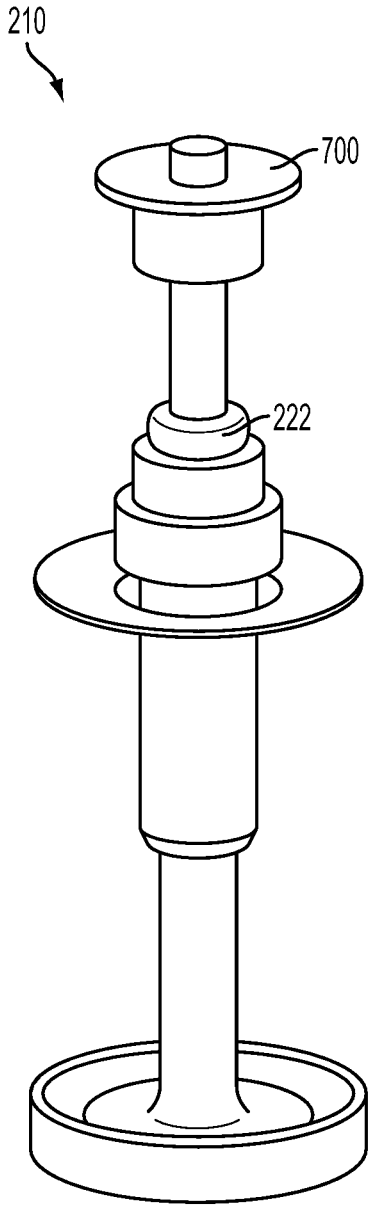
FIG. 7 shows another view of the valve assembly shown in FIG. 2.

FIG. 1 shows a schematic depiction of an engine. FIG. 2 shows a depiction of a valvetrain that may be included in the engine shown in FIG. 1. FIG. 3 shows a first embodiment of an impact dampening tappet included in the valvetrain shown in FIG. 2. FIG. 4 shows a cross-sectional view of a second embodiment of the impact dampening tappet. FIG. 5 shows a third embodiment of an impact dampening tappet. FIG. 6 shows a cross-sectional view of a fourth embodiment of an impact dampening tappet. FIG. 7 shows another view of a valve assembly shown in FIG. 2.

Referring to FIG. 1, internal combustion engine 10, comprising a plurality of cylinders, one cylinder of which is shown in FIG. 1, is controlled by electronic engine controller 12. Engine 10 includes combustion chamber 30 and cylinder walls 32 with piston 36 positioned therein and connected to a crankshaft 40. The engine 10 also includes a cylinder head 90 coupled to a cylinder block 91 to form the combustion chamber 30. Combustion chamber 30 is shown communicating with intake manifold 44 and exhaust manifold 48 via respective intake valve assembly 52 and exhaust valve assembly 54. Each intake and exhaust valve assembly may be operated by an intake cam 51 and an exhaust cam 53. The intake valve assembly 52, the exhaust valve assembly 54, the intake cam 51, and the exhaust cam 53 may be included in a valvetrain 200, discussed in greater detail herein with regard to FIG. 2. Specifically, either the intake cam 51 or the exhaust cam 53 may be included in the camshaft 202 shown in FIG. 2. The intake valve assembly 52 and the exhaust valve assembly 54 may each include an impact dampening tappet 218. The impact dampening tappets 218 may include multiple layers are discussed in greater detail herein with regard to FIGS. 2-6. The valve assembly 210, shown in FIG. 2, may be either the intake valve assembly 52 or the exhaust valve assembly 54, shown in FIG. 1. The position of intake cam 51 may be determined by intake cam sensor 55. The position of exhaust cam 53 may be determined by exhaust cam sensor 57.

Fuel injector 66 is shown positioned to inject fuel directly into cylinder 30, which is known to those skilled in the art as direct injection. Additionally or alternatively, fuel may be injected to an intake port, which is known to those skilled in the art as port injection. Fuel injector 66 delivers liquid fuel in proportion to the pulse width of signal FPW from controller 12. Fuel is delivered to fuel injector 66 by a fuel system (not shown) including a fuel tank, fuel pump, and fuel rail (not shown). Fuel injector 66 is supplied operating current from driver 68 which responds to controller 12. In addition, intake manifold 44 is shown communicating with optional electronic throttle 62 which adjusts a position of throttle plate 64 to control air flow from intake boost chamber 46. In other examples, the engine 10 may include a turbocharger having a compressor positioned in the induction system and a turbine positioned in the exhaust system. The turbine may be coupled to the compressor via a shaft. A high pressure, dual stage, fuel system may be used to generate higher fuel pressures at injectors 66.

Distributorless ignition system 88 provides an ignition spark to combustion chamber 30 via spark plug 92 in response to controller 12. However, in other examples the ignition system 88 may not be included in the engine 10 and compression ignition may be utilized. Universal Exhaust Gas Oxygen (UEGO) sensor 126 is shown coupled to exhaust manifold 48 upstream of catalytic converter 70. Alternatively, a two-state exhaust gas oxygen sensor may be substituted for UEGO sensor 126.

Converter 70 can include multiple catalyst bricks, in one example. In another example, multiple emission control devices, each with multiple bricks, can be used. Converter 70 can be a three-way type catalyst in one example.

Controller 12 is shown in FIG. 1 as a conventional microcomputer including: microprocessor unit 102, input/output ports 104, read-only memory 106, random access memory 108, keep alive memory 110, and a conventional data bus. Controller 12 is shown receiving various signals from sensors coupled to engine 10, in addition to those signals previously discussed, including: engine coolant temperature (ECT) from temperature sensor 112 coupled to cooling sleeve 114; a position sensor 134 coupled to an accelerator pedal 130 for sensing accelerator position adjusted by foot 132; a knock sensor for determining ignition of end gases (not shown); a measurement of engine manifold pressure (MAP) from pressure sensor 122 coupled to intake manifold 44; an engine position sensor from a Hall effect sensor 118 sensing crankshaft 40 position; a measurement of air mass entering the engine from sensor 120 (e.g., a hot wire air flow meter); and a measurement of throttle position from sensor 58. Barometric pressure may also be sensed (sensor not shown) for processing by controller 12. In a preferred aspect of the present description, engine position sensor 118 produces a predetermined number of equally spaced pulses every revolution of the crankshaft from which engine speed (RPM) can be determined.

In some examples, the engine may be coupled to an electric motor/battery system in a hybrid vehicle. The hybrid vehicle may have a parallel configuration, series configuration, or variation or combinations thereof. Further, in some examples, other engine configurations may be employed, for example a diesel engine.

During operation, each cylinder within engine 10 typically undergoes a four stroke cycle: the cycle includes the intake stroke, compression stroke, expansion stroke, and exhaust stroke. During the intake stroke, generally, the exhaust valve assembly 54 closes and intake valve assembly 52 opens. Air is introduced into combustion chamber 30 via intake manifold 44, and piston 36 moves to the bottom of the cylinder so as to increase the volume within combustion chamber 30. The position at which piston 36 is near the bottom of the cylinder and at the end of its stroke (e.g. when combustion chamber 30 is at its largest volume) is typically referred to by those of skill in the art as bottom dead center (BDC). During the compression stroke, intake valve assembly 52 and exhaust valve assembly 54 are closed. Piston 36 moves toward the cylinder head so as to compress the air within combustion chamber 30. The point at which piston 36 is at the end of its stroke and closest to the cylinder head (e.g. when combustion chamber 30 is at its smallest volume) is typically referred to by those of skill in the art as top dead center (TDC). In a process hereinafter referred to as injection, fuel is introduced into the combustion chamber. In a process hereinafter referred to as ignition, the injected fuel is ignited by known ignition devices such as spark plug 92, resulting in combustion. Additionally or alternatively compression may be used to ignite the air/fuel mixture. During the expansion stroke, the expanding gases push piston 36 back to BDC. Crankshaft 40 converts piston movement into a rotational torque of the rotary shaft. Finally, during the exhaust stroke, the exhaust valve assembly 54 opens to release the combusted air-fuel mixture to exhaust manifold 48 and the piston returns to TDC. Note that the above is described merely as an example, and that intake and exhaust valve opening and/or closing timings may vary, such as to provide positive or negative valve overlap, late intake valve closing, or various other examples.

FIG. 2 shows an illustration of an example valvetrain 200. The valvetrain 200 includes a camshaft 202 having a plurality of cams 204. The camshaft 202 is an overhead camshaft in the depicted embodiment. That is to say that the camshaft is positioned vertically above the valve assembly 210 and therefore the cylinders in the engine 10, shown in FIG. 1. However, other camshaft positions have been contemplated. Each of the cams 204 may be configured to actuate a valve. In some examples, the camshaft 202 may be an exhaust camshaft configured to actuate exhaust valves. In other examples, the camshaft 202 may be an intake camshaft configured to actuate intake valves. Therefore, the cams 204 may include cam 51, shown in FIG. 1, or cam 53 shown in FIG. 1. It will be appreciated that the valvetrain 200 may include an intake camshaft and an exhaust camshaft or in the case of an engine having two cylinder banks two intake camshafts and two exhaust camshafts. Further in some embodiments the engine 10 may include two intake and/or two exhaust valves per cylinder.

The valvetrain 200 may further include bearings (not shown) coupled to the camshaft, enabling rotation of the camshaft 202. Furthermore, it will be appreciated that the camshaft 202 may be rotationally coupled to the crankshaft 40, shown in FIG. 1, via suitable linkage such as gears, chains, belts, etc.

Continuing with FIG. 2, the valvetrain 200 may also include a valve assembly 210 having a valve stem 212. The valve stem may include an end 214 configured to seat and seal on an inlet or outlet of a cylinder. Therefore, the end 214 may be configured to seat and seal in a port (e.g., intake port or exhaust port) in the cylinder head 90, shown in FIG. 1. In this way, a portion of the end 214 of the valve assembly 210 may be in contact with the cylinder head 90, shown in FIG. 1, when the valve assembly is in a closed position.

Furthermore, the valve assembly 210 is a poppet valve assembly in the depicted embodiment. However, other valve configurations have been contemplated. The valve assembly 210 further includes a valve guide 216 for guiding the valve stem 212 in a desired direction during valve actuation. The valve guide 216 may be in contact with the cylinder head 90, shown in FIG. 1, in some embodiments. However, in other embodiments the valve guide 216 may not be in contact with the cylinder head 90.

It will be appreciated that one of the cams 204 applies a force to an impact dampening tappet 218 to actuate the valve assembly 210 at cyclical intervals during rotation of the camshaft 202. The impact dampening tappet 218 includes multiple layers such as an elastomeric layer, discussed in greater detail herein. Additionally, the impact dampening tappet is configured to dampen the force transferred from one of the cams 204 to the valve assembly 210. Dampening the impact decreases the likelihood valve assembly degradation and damage. As a result the longevity of the valve assembly is increased. Furthermore, the likelihood of valve malfunctioning due to degraded components is reduced. The noise generated in the valvetrain is also reduced by the impact dampening tappet, thereby reducing the noise, vibration, and harshness (NVH) in the engine.

It will be appreciated that the valvetrain 200 may include additional components such as a cam phaser configured to adjust the timing of cams 204. Specifically, the cam phaser may be configured to advance and/or retard the timing of the cams based on the operating conditions in the engine.

The valve assembly 210 further includes a spring 220. A coil spring is shown in FIG. 2. However, other types of springs have been contemplated. The valve assembly 210 may further include a seal 222, shown in greater detail in FIG. 7. The seal 222 may be an elastomer seal. The valve assembly 210 also includes a supporting platform 224. The supporting platform 224 may be in contact with the cylinder head 90, shown in FIG. 1. The supporting platform may exert an opposing force on the spring 220 when the spring is compressed. It will be appreciated that each cam 204, shown in FIG. 2, may include an associated valve assembly in other embodiments.

Specifically, FIG. 3 shows a perspective view of an example impact dampening tappet 218. As shown, the impact dampening tappet 218 includes multiple layers. In particular, the impact dampening tappet 218 includes an exterior metal layer 300 and an interior elastomeric layer 302. However, alternate or additional layers in the impact dampening tappet 218 have been contemplated. The ratio of the thickness of the metal layer 300 to the elastomeric layer 302 may be 10-0.5 to keep a desired clearance with exterior of the coil spring. Additionally, the metal layer 300 and the elastomeric layer 302 are contiguous and extend across the top of the tappet and down the sides of the tappet. However, other layer configurations have been contemplated.

The exterior metal layer 300 may comprise steel, aluminum, iron, copper, and/or composite material. The elastomeric layer 302 may comprise a thermosetting plastic. Furthermore, the elastomeric layer 302 may comprise at least one of ethylene propylene rubber (EPM), nylon, a mastic material, foam, and/or damping absorbing materials. The impact dampening tappet 218 has a cylindrical shape. However, other geometries have been contemplated.

Additionally, the interior elastomeric layer 302 extends around an interior surface of the exterior metal layer 300, in the depicted embodiment. However, other geometries have been contemplated. The impact dampening tappet 218 includes a top section 304 the top section includes a cam contacting side 305 included in the exterior metal layer 300 and a valve contacting side 306 included in the interior elastomeric layer 302. The top section 304 is disk shaped in the depicted embodiment. However, other geometries may be used in other embodiments.

The cam contacting side 305, shown in FIG. 3, may be planar. However, in other embodiments the cam contacting side 305 may include a raised or recessed section contacting one of the cams 204, shown in FIG. 2. Additionally, the valve contacting side 306 includes a raised section 308. The raised section may be configured to contact valve assembly 210, shown in FIG. 2. Specifically, the raised section 308 may be configured to contact a retainer 700, shown in FIG. 7. In this way, the tappet 218 can transfer energy to the valve assembly 210 from one of the cam 204 to actuate the valve assembly, shown in FIG. 2.

Continuing with FIG. 3, the tappet 218 further includes a skirt 310. The skirt 310 may be referred to as a lower section and the top section 304 may be referred to as an upper section. In the depicted embodiment the skirt 310 is annular. However, other shapes may be used in other embodiments. The skirt 310 partially encloses the valve assembly 210, shown in FIG. 2, and in particular a portion of the valve stem 212 and the coil spring 220.

The impact dampening tappet 218 may be manufactured using a number of different techniques. For example, the interior elastomeric layer 302 may be press fit into the exterior metal layer 300. That is to say that the interior elastomeric layer 302 may be sized to provide a desired amount of friction on the exterior metal layer 300 when assembled. In some examples, the allowance of the interior elastomeric layer 302 may be 0.1 mm-2.0 mm to keep a desired clearance from the exterior of the coil spring. Additionally or alternatively, the interior elastomeric layer 302 may be attached to the exterior metal layer 300 using adhesive. Thus, a layer of adhesive (e.g., epoxy) may be positioned between the elastomeric layer 302 and the metal layer 300.

FIG. 4 shows a cut-away view of another example impact dampening tappet 218. As shown, the tappet 218 includes a 3$^{rd}$ layer. The third layer is referred to as an interior metal layer 400. In some examples, the interior metal layer 400 may comprise a different material than the exterior metal layer 300. For example, the interior metal layer may comprise aluminum and the exterior metal layer may comprise steel (e.g., stainless steel).

Moreover, the exterior metal layer 300 and the interior elastomeric layer 302 extend across the top of the tappet 218 and down the skirt 310 each forming a continuous piece of material. However, in other embodiments the exterior metal layer 300 and/or the interior elastomeric layer 302 may includes sections spaced away from one another. Further in some embodiments, the interior elastomeric layer 302 may not extend down the skirt 310. In this way, interior elastomeric layer 302 may be positioned further away from the cylinder which may reduce the temperature of the elastomeric layer, thereby reducing the likelihood of thermal degradation.

In some examples, the interior elastomeric layer 302 may axially extend beyond the interior metal layer 400 and/or exterior metal layer 300 and also extends in a radial direction. A radial axis 450 and axial axis 452 are provided for reference. In this way, the rim of the exterior metal layer 300 may be protected.

The relative thicknesses of the layers may vary. In the depicted embodiment, the exterior metal layer 300 is thicker than the interior metal layer 400 and the interior elastomeric layer 302. Specifically, the ratio between the exterior metal layer 300 and the interior metal layer 400 may be in the following range 3-1. Additionally, the ratio between the thickness of the interior metal layer 400 and the interior elastomeric layer 302 is 1 in the depicted embodiment. Specifically, the thickness of the interior metal layer 400 is 0.5 millimeters (mm) and the thickness of the interior elastomeric layer 302 is 0.5 mm. However, other thicknesses have been contemplated.

Sandwiching the elastomeric layer 302 between two metal layers (e.g., interior metal layer 400 and exterior metal layer 300) holds the elastomeric layer in position which reduces deformation of the elastomeric caused by temperature variations. Moreover, the sandwich construction provides spring-mass isolation function, enabling damping of un-wanted frequencies such as high frequencies, if desired.

FIG. 4 also shows the top section 304 including the valve contacting side 306 and the cam contacting side 305. The valve contacting side 306 includes a valve actuating surface 410. The valve actuating surface may be in contact with the valve stem 212, shown in FIG. 2, the spring 220, and/or the retainer 700 shown in FIG. 7. In the depicted embodiment the valve actuating surface 410 is included in the interior metal layer 400. However, in other embodiments the valve actuating surface 410 may be included in the elastomeric layer 302. Additionally, the cam contacting side 305 includes a cam contacting surface 412. In the depicted embodiment the cam contacting surface 412 is included in the exterior metal layer 300. FIG. 4 shows the interior elastomeric layer 302 traversing at least a portion of the interior surface 430 of the exterior metal layer 300. Specifically, the interior elastomeric layer 302 is shown traversing the entire interior surface 430. However, other elastomeric layer configurations have been contemplated.

The impact dampening tappet 218 also has a void 440 whose boundary is defined by the interior surface of the tappet. The valve assembly 210, shown in FIG. 2, may partially extend into the void 440. Each of the layers in the tappet (i.e., the exterior metal layer 300, the interior elastomeric layer 302, and the interior metal layer 400 are contiguous in the embodiment depicted in FIG. 2. In particular, each of the layers contiguously extends across the top portion of the tappet and down the sides of the tappet. However, in other embodiments one or more of the layers may not be contiguous.

Further in some examples, a ring component 432 (e.g., nylon ring) may be included in the tappet 218. The ring component 432 may be positioned inside of the elastomeric layer 302 and configured to apply a force (e.g., outward radial force) on the elastomeric layer 302 to increase the friction between the interior elastomeric layer 302 and the exterior metal layer 300 to reduce the relative movement between the aforementioned elements. Thus, the nylon ring may be preloaded to snap into the elastomeric layer 302. However, in other examples the nylon ring may be integrated into the elastomeric layer 302.

As shown in FIG. 4 a top portion of the exterior metal layer has a greater thickness than a lower portion of the metal layer. Further in some examples, the thickness of an upper portion of the elastomeric layer may have a greater thickness than a lower portion of the elastomeric layer.

FIG. 5 shows another embodiment of the impact dampening tappet 218. The interior elastomeric layer 302 is depicted. In the example shown in FIG. 5 the interior elastomeric layer 302 is a mastic material. During construction of the impact dampening tappet 218 the mastic material may be applied (e.g., sprayed) onto the metal layer. In other examples, the elastomeric layer 302 may comprise nylon and an epoxy layer may be used to couple the exterior metal layer to the interior elastomeric layer. In some embodiments a layer of adhesive (e.g., epoxy) may be positioned between the exterior metal layer and the interior elastomeric layer 302. As shown, the interior elastomeric layer 302 radial extends beyond the exterior metal layer. Thus, viewing of the exterior metal layer is obstructed in FIG. 5.

FIG. 6 shows another embodiment of the impact dampening tappet 218. As shown the tappet includes a second elastomeric layer 600. The second elastomeric layer 600 is at least partially enclosed by the first interior elastomeric layer 302 and the exterior metal layer 300. FIG. 6 includes some of the features, components, etc., included in impact dampening tappet 218 shown in FIG. 3. Therefore, similar parts are labeled accordingly. The second elastomeric layer 600 may comprise a different material than the first elastomeric layer 302. Further, in some embodiments the second elastomeric layer 600 may have a different compressibility and/or elasticity than the first elastomeric layer 302. The materials used to construct the first and second elastomeric layers (302 and 600) may be selected based on their material characteristics such as compressibility, to enable desired frequency ranges to be dampened via the impact dampening tappet 218. In this way, noise, vibration, and harshness (NVH) in the engine may be reduced. As a result customer satisfaction is improved. However, in other embodiments the second elastomeric layer 600 may be constructed out of a similar material as the first elastomeric layer. Further, in other embodiments the first elastomeric layer 302 may have a different thickness than the second elastomeric layer 600. The thicknesses of the elastomeric layers may be selected to provide dampening in a desired frequency range.

Each of the layers in the tappet 218 shown in FIG. 6 (i.e., the exterior metal layer 300, the first elastomeric layer 302, the second elastomeric layer 600, and the interior metal layer 400) is contiguous, in the depicted embodiment. Specifically, each of the layers contiguously extends across the top of the tappet and down the sides of the tappet. However, other layer configurations have been contemplated. For example, only a portion of the layers may extend down the sides of the tappet, such as the exterior metal layer.

FIG. 7 shows another view of the valve assembly 210, shown in FIG. 2. The spring 220 is omitted from the valve assembly 210, shown in FIG. 7. However, it will be appreciated that the valve assembly 210 may include the spring. As shown, the valve assembly 210 includes the seal 222. The seal 222 may be enclosed by the spring 220, shown in FIG. 2. The valve assembly 210 also includes a retainer 700. The retainer 700 is in contact with the spring 220, shown in FIG. 2. The retainer 700 transfers the force from the tappet 218 to the valve assembly 210.

It has been found, through testing, that when the impact dampening tappet 218, described above, is used in a valvetrain the lateral as well as vertical forces on the tappet are reduced when compared to a tappet constructed solely out of metal. Furthermore, it has been found through testing, that when the impact dampening tappet 218 described here is used in a valvetrain the noise generated via impact of the cam with the tappet is reduced.

This concludes the description. The reading of it by those skilled in the art would bring to mind many alterations and modifications without departing from the spirit and the scope of the description. For example, single cylinder, inline engines, V-engines, and horizontally opposed engines operating in natural gas, gasoline, diesel, or alternative fuel configurations could use the present description to advantage.

The invention claimed is:

1. A valve assembly comprising:

an overhead camshaft;

a valve stem coupled to a coil spring; and an impact dampening tappet partially enclosing and in direct contact with the spring and the valve stem and in direct contact with a cam of the camshaft, the tappet including an exterior metal layer having a cam contacting surface and an interior elastomeric layer comprising nylon contiguous with and extending across a top surface of the exterior metal layer, and an interior metal layer including a valve actuating surface in contact with the valve stem, the interior elastomeric layer positioned between the exterior metal layer and the interior metal layer.

2. The valve assembly of claim 1, where the interior metal layer and the exterior metal layer comprise different materials.

3. The valve assembly of claim 1, where the interior elastomeric layer includes the valve actuating surface in contact with the valve stem, and where the interior elastomeric layer is on a valve contacting side of the impact dampening tappet.

4. The valve assembly of claim 1, where the interior elastomeric layer is press fit into the exterior metal layer.

5. The valve assembly of claim 1, where the interior elastomeric layer includes a ring component positioned inside the interior elastomeric layer configured to apply a radial force on the interior elastomeric layer.

6. The valve assembly of claim 1, where a ratio between a thickness of the exterior metal layer and a thickness of the interior elastomeric layer is between 10 and 0.5.

7. The valve assembly of claim 1, where the interior elastomeric layer comprises a mastic material.

8. The valve assembly of claim 1, where the exterior metal layer has a smaller thickness than the interior elastomeric layer.

9. The valve assembly of claim 1, further comprising a second interior elastomeric layer having a different elasticity than a first elastomeric layer.

10. The valve assembly of claim 1, where the interior elastomeric layer traverses an entire interior surface of the exterior metal layer.

11. The valve assembly of claim 1, where a camshaft is the overhead camshaft positioned vertically above a cylinder in an internal combustion engine.

* * * * *